US011162366B2

(12) United States Patent
Zamai et al.

(10) Patent No.: US 11,162,366 B2
(45) Date of Patent: Nov. 2, 2021

(54) ROTOR DISC WITH AXIAL STOP OF THE BLADES, ASSEMBLY OF A DISC AND A RING AND TURBOMACHINE

(71) Applicant: SAFRAN AIRCRAFT ENGINES, Paris (FR)

(72) Inventors: Laurent Cédric Zamai, Moissy-Cramayel (FR); Benoit Guilhem Bruno Jeannin, Moissy-Cramayel (FR); Loïc Fabien François Villard, Moissy-Cramayel (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 0 days.

(21) Appl. No.: 16/784,581

(22) Filed: Feb. 7, 2020

(65) Prior Publication Data

US 2020/0263548 A1 Aug. 20, 2020

(30) Foreign Application Priority Data

Feb. 19, 2019 (FR) ..... 1901636

(51) Int. Cl.
*F01D 5/08* (2006.01)

(52) U.S. Cl.
CPC ..... *F01D 5/08* (2013.01); *F05D 2240/24* (2013.01)

(58) Field of Classification Search
CPC . F01D 5/08; F01D 5/02; F01D 5/3007; F05D 2260/20; F05D 2260/30; F05D 2230/644; F05D 2240/24
See application file for complete search history.

(56) References Cited

U.S. PATENT DOCUMENTS 4,505,640 A 3/1985 Hsing et al.
4,904,160 A 2/1990 Partington
8,807,942 B2 * 8/2014 Tibbott ..... F01D 5/085 416/96 R (Continued)

FOREIGN PATENT DOCUMENTS

EP 2372094 A2 * 10/2011 ..... F01D 5/26
EP 2372094 A2 10/2011

(Continued)

OTHER PUBLICATIONS

French Search Report in French Application No. FR1857926, dated Jun. 24, 2019, (2 pages).

(Continued)

*Primary Examiner* — Justin D Seabe
*Assistant Examiner* — Ryan C Clark
(74) *Attorney, Agent, or Firm* — Bookoff McAndrews, PLLC

(57) ABSTRACT

A rotor disc for a turbomachine, the disc extending circumferentially around an axis and including a plurality of cells configured to receive blade roots and each cell including an upstream radial wall configured to axially block the blade root in the cell, each cell being connected to an upstream surface of the disc by a ventilation channel of the cell, the ventilation channel including an inlet orifice which opens onto the upstream surface of the disc and an outlet orifice which opens into the cell. An assembly of such a disc, of a plurality of blades and of a downstream retaining ring and a turbomachine including such an assembly.

12 Claims, 10 Drawing Sheets

(56) References Cited

U.S. PATENT DOCUMENTS

| | | | | |
|---|---|---|---|---|
| 9,353,643 | B2 * | 5/2016 | Major | F01D 17/162 |
| 9,435,213 | B2 * | 9/2016 | Wunderle | F01D 11/005 |
| 10,443,402 | B2 * | 10/2019 | Burford | F01D 5/3015 |
| 2006/0120855 | A1 | 6/2006 | Djeridane et al. | |
| 2015/0125301 | A1 * | 5/2015 | Headland | F01D 11/006 416/174 |
| 2016/0186593 | A1 * | 6/2016 | Healy | F01D 5/326 416/182 |
| 2016/0222810 | A1 * | 8/2016 | Leduc | F01D 5/22 |
| 2016/0230579 | A1 * | 8/2016 | Schwartz | F01D 5/326 |
| 2016/0273370 | A1 * | 9/2016 | Belshaw | F01D 25/12 |
| 2017/0067356 | A1 * | 3/2017 | Vogel | F01D 5/3007 |

FOREIGN PATENT DOCUMENTS

| | | | |
|---|---|---|---|
| EP | 2518271 | A2 | 10/2012 |
| EP | 2557272 | A1 | 2/2013 |
| GB | 631152 | A | 10/1949 |

OTHER PUBLICATIONS

International Search Report in International Application No. PCT/FR2019/051963, dated Dec. 13, 2019, (2 pages).
French Search Report dated Sep. 4, 2019, in corresponding FR Application No. 1901636 (2 pages).

* cited by examiner

ROTOR DISC WITH AXIAL STOP OF THE BLADES, ASSEMBLY OF A DISC AND A RING AND TURBOMACHINE

CROSS REFERENCE TO RELATED APPLICATIONS

This application claims the benefit of priority to French Patent Application No. 1901636, filed on Feb. 19, 2019, the disclosure of which is incorporated by reference herein in its entirety.

TECHNICAL FIELD

The present disclosure concerns a rotor disc for a turbomachine, for example a low pressure turbine rotor disc of a turbojet engine.

PRIOR ART

In a known manner, a turbomachine includes an aerodynamic flow path in which moving wheels (portion of the rotor) which recover the energy from the gases from the combustion chamber and the distributors (portion of the stator) which straighten the gas flow in the aerodynamic flow path, succeed one another. The moving wheels generally include a disc movable in rotation about an axis of rotation, the disc being provided with blades. The blades may be manufactured separately and assembled on the disc by fitting the blade roots into the disc cells. The shape of the cells is generally obtained by broaching each cell. The cells are therefore through cells. As a result, the blades are generally axially blocked on their upstream and downstream faces by retaining rings.

In particular in a low pressure turbine of a turbomachine, the axial retaining rings of the blades generally located upstream and downstream of the blade roots are subjected to stresses which may cause gas leaks.

Generally, the gas leaks at the blade root are controlled by the dimensioning of the cells of the disc and of the cooling orifices of the movable ring bearing against the retaining ring. This movable ring rotates about the axis of rotation with the rotor and generally bears against two successive stages of the turbine rotor, the movable ring being axially clamped between the two stages in order to guarantee the axial blocking of the blades in the disc.

DISCLOSURE OF THE INVENTION

The present disclosure aims at overcoming these disadvantages at least in part.

To this end, the present disclosure concerns a rotor disc for a turbomachine, the disc extending circumferentially around an axis and including a plurality of cells configured to receive and radially retain blade roots and each cell including an upstream radial wall configured to axially block the blade root in the cell, each cell being connected to an upstream surface of the disc by a ventilation channel of the cell, the ventilation channel including an inlet orifice which opens onto the upstream surface of the disc and an outlet orifice which opens into the cell.

The axis of rotation of the disc defines an axial direction which corresponds to the direction of the axis of symmetry (or quasi-symmetry) of the disc. The radial direction is a direction perpendicular to the axis around which the disc extends circumferentially and intersecting this axis. Similarly, an axial plane is a plane containing the axis of the disc and a radial plane is a plane perpendicular to this axis. The circumferential direction is a direction along a circle which lies in a radial plane and whose center is the axis of rotation.

Unless otherwise specified, the adjectives "internal/inner" and "external/outer" are used with reference to a radial direction so that the internal portion of an element is, along a radial direction, closer to the axis of the turbomachine than the external portion of the same element. It will be noted that the terms "upstream" and "downstream" are defined relative to the direction of air circulation in the turbomachine.

Each cell including an upstream radial wall, it is possible to axially block the blade in the cell and to dispense with the use of an upstream retaining ring.

It is understood that the upstream radial wall may be integral with the disc.

In addition, due to the absence of the upstream retaining ring, it is also possible to remove the holding hook of the upstream retaining ring of the blade. Thus, the blade, in particular the blade root and the inner platform, may have a simpler geometric shape. The blade manufacturing is therefore less complex.

Furthermore, due to the presence of the upstream radial wall, it is also possible to have a retaining ring which is integrated into the labyrinth ring and to dispense with the downstream portion of the movable ring, that is to say the portion of the movable ring downstream of the sealing wipers. Indeed, the movable disc may no longer be in compression between two rotor stages to hold the downstream retaining ring. When the stage is the first stage of the rotor, it is possible to dispense with the upstream movable ring which is present to hold the upstream retaining ring when the latter is present in the turbomachine.

Each cell being configured to radially retain a blade root, particularly a blade root bulb, it is understood that the shape of the cell is substantially complementary to the shape of the blade root bulb. The shape of the cell is configured so that, when a blade is mounted on the disc and the disc is rotated, the blade is retained into the cell by cooperation of the blade root bulb and the walls of the cell.

The assembly of the stages of the rotor, and particularly of the blades on the discs of the different stages of the rotor, is less complex and involves the use of a reduced number of elements. A reduction in the rotor weight is thus obtained.

Thanks to the presence of a ventilation channel including the inlet orifice which opens onto an upstream surface of the disc and an outlet orifice which opens into each cell, it is possible to ventilate each cell and thus ensure efficient and homogeneous cooling of all the cells of the disc.

In addition, the cooling of the disc is controlled by the dimension of the inlet orifice of the ventilation channel.

It is understood that an inlet orifice may be common to several ventilation channels.

The ventilation channel may include a circumferential channel connecting all the inlet orifices with each other.

It is understood that the ventilation channel may have a shape other than a circumferential shape.

Thanks to this arrangement, it is possible to reduce the air flow leaks in the cooling flow. The flow rate of the cooling flow may therefore be better controlled and therefore reduced, which allows increasing the purge flow rate upstream of the first moving wheel at constant total flow rate (purge flow and cooling flow). Thus, this arrangement allows improving the efficiency of the turbomachine.

The turbomachine may for example be a turbojet engine.

The rotor may for example be a turbine rotor.

The turbine may for example be a low pressure turbine.

In some embodiments, in an axial cross-sectional plane, the ventilation channel has an inclination relative to the radial direction.

This inclination facilitates the penetration of the air flow into the ventilation channel. This inclination may form an angle comprised between 0° and 60°. This inclination may also have a tangential inclination.

In some embodiments, the upstream radial wall of the cell is prolonged outward in a radial direction to form an extended upstream radial wall.

It is understood that the extended upstream radial wall extends from the inside to the outside of the disc in the radial direction beyond the cell.

Thus, inter-blading leaks are reduced. Indeed, generally, the blades are disposed circumferentially one next to the other, the platforms of two adjacent blades being in contact with each other. Each inner platform is generally connected to the blade root of the blade by a shank. The spaces between two adjacent shanks as well as between two adjacent platforms are sources of gas leaks. The upstream radial wall extending radially from the inside to the outside, the radial wall is disposed upstream of at least one portion of the shanks, reducing the leaks between the shanks.

In some embodiments, the disc includes a radial bearing surface configured to form a radial end stop of a blade platform.

Thus, when a blade is inserted into the cell and the cavity, the blade, particularly the inner platform of the blade, bears against the radial bearing surface of the disc disposed in particular on the extended upstream radial wall. This radial bearing surface allows a simplified and stable radial positioning of the blade. The radial bearing surface also allows ensuring that there is a space between the cell walls and the blade root so that the cooling air flow may circulate in the cell. This radial bearing surface is a radial bearing surface at rest. Indeed, when the turbomachine rotates, under the effect of the centrifugal force, the inner platform may separate from the bearing surface. In operation, the blade is held in the cavity by cooperation of the blade root bulb with the teeth.

In some embodiments, the upstream radial wall includes an upstream spoiler.

Thus, the blade, in particular the inner platform, may have a simpler geometric shape, the inner platform being devoid of an upstream spoiler. The blade manufacturing is therefore less complex.

In addition, when the upstream spoiler is integral with the disc, particularly with the upstream radial wall, more particularly with the extended upstream radial wall, it is possible to better control the positioning of the upstream spoiler relative to the elements disposed upstream of the upstream spoiler, so that the air flow passing between the element disposed upstream of the upstream spoiler and the upstream spoiler, for example of purge flow, is better controlled.

In some embodiments, the upstream radial wall includes an axial stop surface configured to form an axial end stop of a blade.

Thus, when a blade is inserted into the cell and the cavity, the blade is axially stopped by the axial stop surface disposed on the extended upstream radial wall. Therefore, the blade root may not be the portion of the blade in axial abutment.

Each cell opens into a blade shank receiving cavity.

It is understood that the extended upstream radial wall delimits the shank receiving cavity. Thus, the extended upstream radial wall extends radially to the inner platform of the blade. Thus, the leaks between the shanks are reduced. The shank is the portion of the blade that connects the blade root bulb to the inner platform of the blade.

The shank receiving cavity is delimited by inter-cavity walls disposed circumferentially and extending radially outward in the continuation of the teeth delimiting the cells.

Thus, each shank may be received in a separate cavity. The mechanical strength of the disc is improved.

It is also understood that the radial bearing surface may be carried by the inter-cavity walls. This also allows performing the anti-tip of the moving wheel and improving the sealing between the disc and the blade thanks to the bearing of the inner platform of the blade on the radial bearing surface carried by the extended upstream wall and the inter-cavity walls.

In some embodiments, the radial bearing surface is prolonged to the cavity by a sealing bearing surface of a seal carried by a blade.

It is possible to integrate a sealing between the disc and the blade by providing, between a blade and the disc, a bearing surface of a seal carried by the blade and therefore improve the efficiency of the turbine.

In some embodiments, each cavity is configured to receive a blade shank and two damping elements disposed circumferentially on both sides of the shank.

The cavity is configured so that the shank is sandwiched between two damping elements. It is understood that each damping element is sandwiched between the shank and the inter-cavity wall. Thus, each shank being received in a separate cavity, it is possible to improve the correct orientation of one of the dampers.

The damping elements maintain their function of attenuating the vibrational modes of the blade by having a freedom of movement in the cavity.

In some embodiments, the disc includes an attached crown at least partially defining the cells, the ventilation channel of the cell being partially defined in the disc and in the crown.

The cells in the crown may for example be made by broaching. The broaching method allows reducing the manufacturing costs of the cells. The crown is a separate part attached on the body of the disc to form the cells of the disc. The crown being a separate part attached on the body of the disc, it is possible, when the cells are worn out, to replace the crown without having to replace the whole disc and to disassemble and reassemble each blade on the disc.

For example, the crown may carry teeth, each cell being radially delimited by two circumferentially adjacent teeth.

In some embodiments, the disc includes a downstream spoiler.

Thus, the blade, in particular the inner platform, may have a simpler geometric shape, the inner platform being devoid of a downstream spoiler. The blade manufacturing is therefore less complex.

In some embodiments, the inlet orifices have a frusto-conical shape widening from downstream to upstream.

The widening of the frusto-conical shape allows limiting the pressure drop in the ventilation channel.

In some embodiments, the inlet orifices have an inlet diameter and the outlet orifices have an outlet diameter, the number of inlet orifices being less than or equal to the number of outlet orifices and the inlet diameter being less than or equal to the outlet diameter.

When the number of inlet orifices is less than the number of outlet orifices, the manufacture of the disc is facilitated because the number of inlet orifices is limited.

Moreover, when the outlet diameter is greater than the inlet diameter, the removal of dust which may be present in the air flow is facilitated.

In some embodiments, at least one of the inlet orifices is axially aligned with at least one of the outlet orifices.

The orifices being of generally circular shape, it is understood that the center of the circle forming the inlet orifice and the center of the circle forming the outlet orifice are aligned in a direction parallel to the axis of rotation when a line segment connecting the center of the inlet orifice to the center of the outlet orifice is parallel to the axis of rotation.

In some embodiments, at least one of the inlet orifices is circumferentially and/or radially offset from at least one of the outlet orifices.

Thus, the center of the circle forming the inlet and the center of the circle forming the outlet may be offset from each other in a circumferential and/or radial direction.

In some embodiments, the upstream radial wall has a thickness greater than or equal to 0.5 mm (millimeter) and less than or equal to 10 mm.

The thickness of the walls allows limiting the weight of the disc.

In some embodiments, the inlet orifices have a diameter greater than or equal to 0.5 mm and less than or equal to 10 mm.

The inlet orifice having a diameter greater than or equal to 0.5 mm allows limiting the risk of fouling of the ventilation channel.

In some embodiments, the outlet orifices have a diameter greater than or equal to 0.5 mm and less than or equal to 10 mm.

The outlet orifice having a diameter greater than or equal to 0.5 mm allows limiting the risk of fouling of the ventilation channel.

The present disclosure also concerns an assembly of a disc as defined above, of a plurality of blades, a blade root being received in each cell and of a downstream retaining ring fastened on the disc and configured to axially block the blade root in the cell.

In some embodiments, the downstream retaining ring is made in one piece with a movable ring.

The movable ring rotates about the axis of rotation with the rotor and bears against a downstream face of the disc of the turbine rotor.

Thus, the blade may be free of a hook for holding the downstream retaining ring of the blade. Thus, the blade, in particular the blade root and the inner platform, may have a simpler geometric shape. The blade manufacturing is therefore less complex.

In some embodiments, the downstream retaining ring is shrink-fitted onto the disc.

Thus, the blade may be free of a hook for holding the downstream retaining ring of the blade. Thus, the blade, in particular the blade root and the inner platform, may have a simpler geometric shape. The blade manufacturing is therefore less complex. Furthermore, the downstream retaining ring may thus be a simple part having an axial symmetry and may be devoid of a slot allowing the adjustment and the fastening of the downstream retaining ring.

In some embodiments, the blade root is coated with a foil.

The foil allows protecting the disc and the blade root against the wear of friction between these two parts.

In some embodiments, at least one blade includes a seal receiving groove and a seal received in the groove, the disc including a radial bearing surface configured to form a radial end stop of a blade platform, the radial bearing surface being prolonged to the cavity by a sealing bearing surface of a seal carried by a blade, the seal cooperating with the sealing bearing surface of the disc.

It is possible to integrate a sealing between the disc and the blade by providing, between each blade and the disc, a bearing surface of a seal carried by the blade and therefore improve the efficiency of the turbine. The seal being received in a seal receiving groove, the position of the seal is determined by the groove and the seal is blocked in the groove.

The present disclosure also concerns a turbomachine including an assembly as defined above.

It is understood that the turbomachine may include one or more stage(s) including an assembly as defined above. For example, the turbomachine may be a turbojet engine. For example, the assembly as defined above may be disposed in the low pressure turbine of the turbojet engine.

BRIEF DESCRIPTION OF THE DRAWINGS

Other characteristics and advantages of the object of the present disclosure will emerge from the following description of embodiments, given by way of non-limiting examples, with reference to the appended figures.

In all of the figures, the common elements are identified by identical reference numerals.

DETAILED DESCRIPTION

Figure 1:
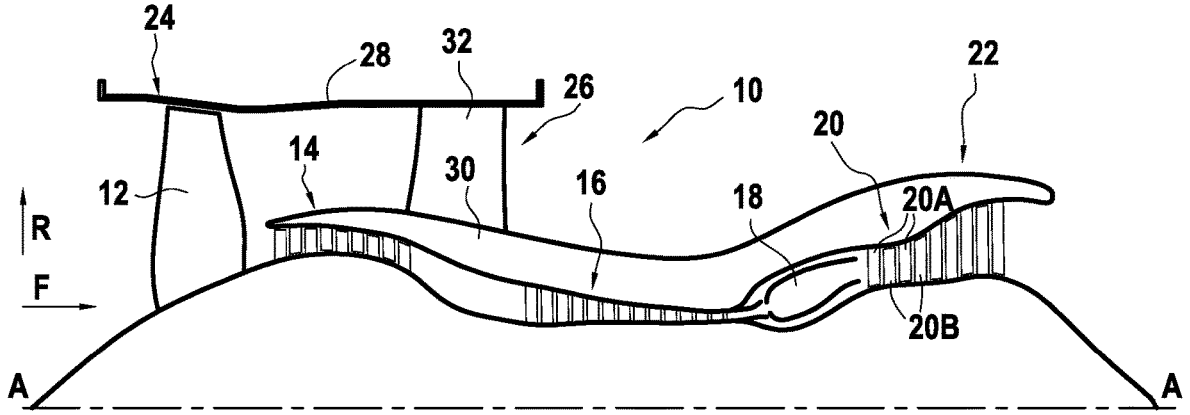
FIG. 1 is a schematic longitudinal sectional view of a turbojet engine.

FIG. 1 shows in section along a vertical plane passing through its main axis A, a bypass turbojet engine 10 which is an example of a turbomachine. The bypass turbojet engine 10 includes, from upstream to downstream according to the circulation of the air flow F, a fan 12, a low pressure compressor 14, a high pressure compressor 16, a combustion chamber 18, a high pressure turbine 20, and a low pressure turbine 22.

The terms "upstream" and "downstream" are defined relative to the direction of air circulation in the turbomachine, in this case, according to the circulation of the air flow F in the turbojet engine 10.

The turbojet engine 10 includes a fan casing 24 prolonged rearward, that is to say downstream, by an intermediate casing 26, including an outer shroud 28 as well as an inner shroud 30 which is coaxial and disposed, in a radial direction R, internally relative to the outer shroud 28. The radial direction R is perpendicular to the main axis A. The main axis A is the axis of rotation of the turbomachine.

The terms "outer" and "inner" are defined relative to the radial direction R so that the inner portion of an element is, in the radial direction, closer to the main axis A than the outer portion of the same element.

The intermediate casing 26 further includes structural arms 32 distributed circumferentially and extending radially between the inner shroud 30 to the outer shroud 28. For example, the structural arms 32 are bolted on the outer shroud 28 and on the inner shroud 30. The structural arms 32 allow stiffening the structure of the intermediate casing 26.

The main axis A is the axis of rotation of the turbojet engine 10 and of the low pressure turbine 22. This main axis A is therefore parallel to the axial direction.

The low pressure turbine 22 includes a plurality of blade wheels which form the rotor of the low pressure turbine 22.

Figure 2:
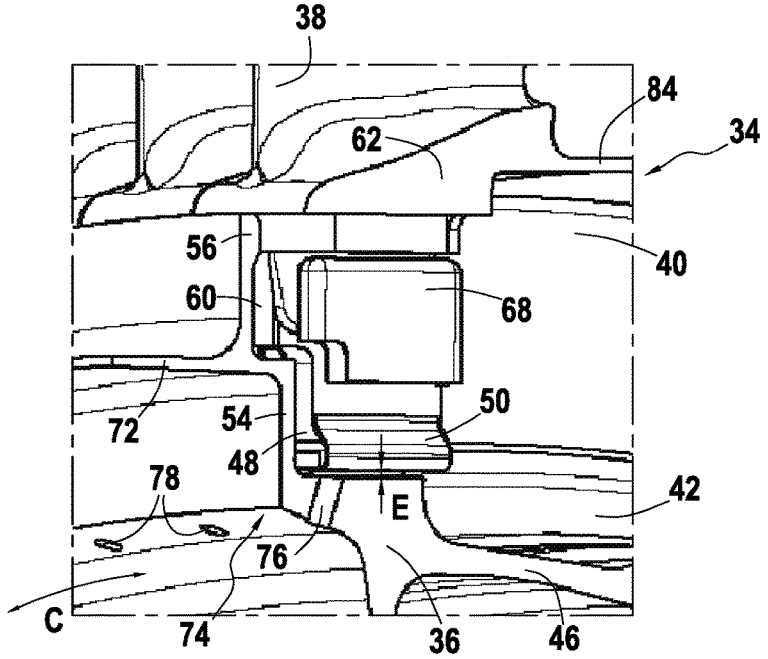
FIG. 2 is a partial and perspective view in partial section of a portion of FIG. 1 showing an assembly according to a first embodiment.
Figure 3:
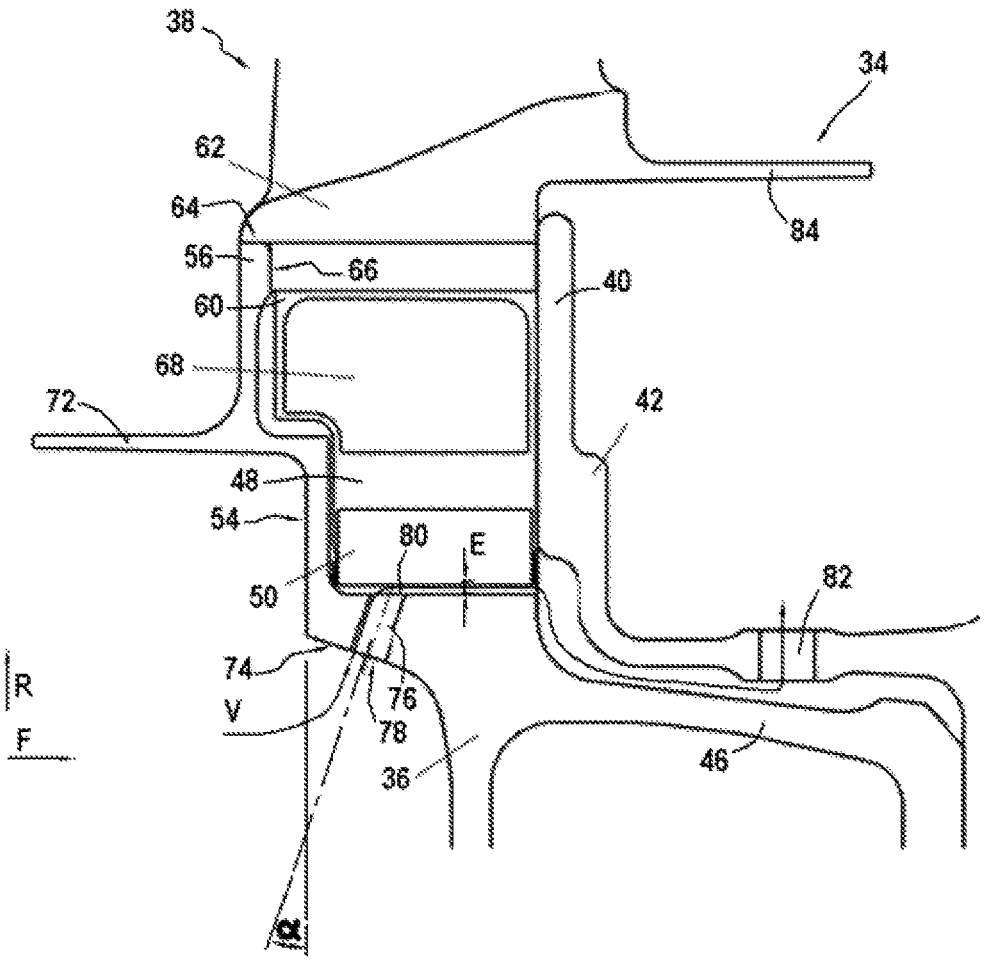
FIG. 3 is a side view of the assembly of FIG. 2.

FIG. 2 is a partial and perspective view in partial section of a portion of FIG. 1 showing an assembly 34 according to a first embodiment and FIG. 3 is a side view of the assembly 34 of FIG. 2.

The assembly 34 of FIGS. 2 and 3, for example a rotor stage of the low pressure turbine, includes a rotor disc 36 extending circumferentially around the main axis A and on the periphery of which are assembled blades 38. The assembly 34 also includes a downstream retaining ring 40.

In the embodiment of FIGS. 2 and 3, the downstream retaining ring 40 is made in one piece with a movable ring 42. Thus, the blade 38 is devoid of a hook for holding the downstream retaining ring 40.

Figure 5:
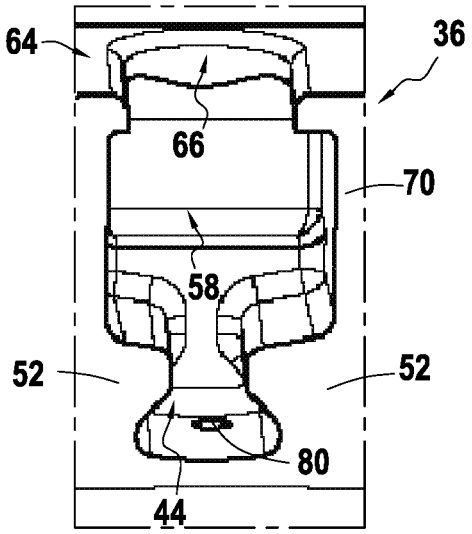
FIG. 5 is a partial perspective view of the turbine disc of FIG. 3.
Figure 6:
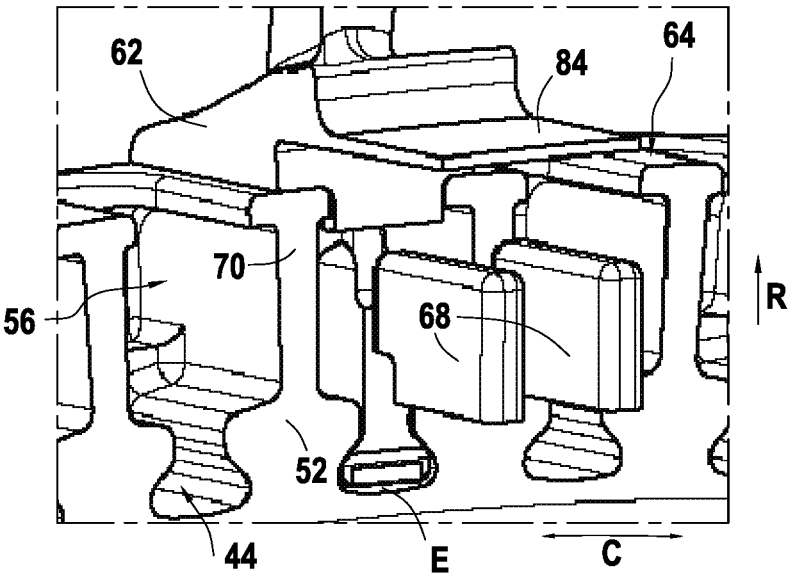
FIG. 6 is a partial perspective view of a step of assembling the assembly of FIG. 3.
Figure 7:
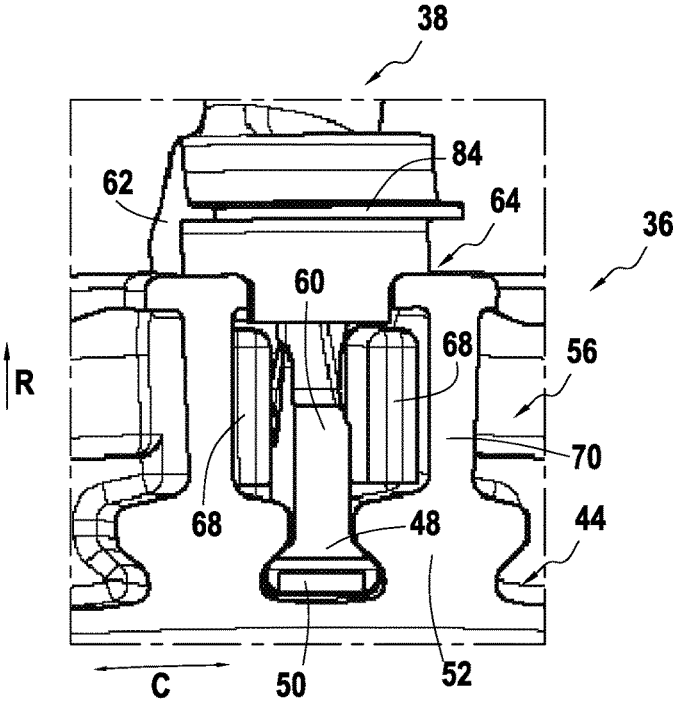
FIG. 7 is a partial perspective view of a step of assembling the assembly of FIG. 3.
Figure 8:
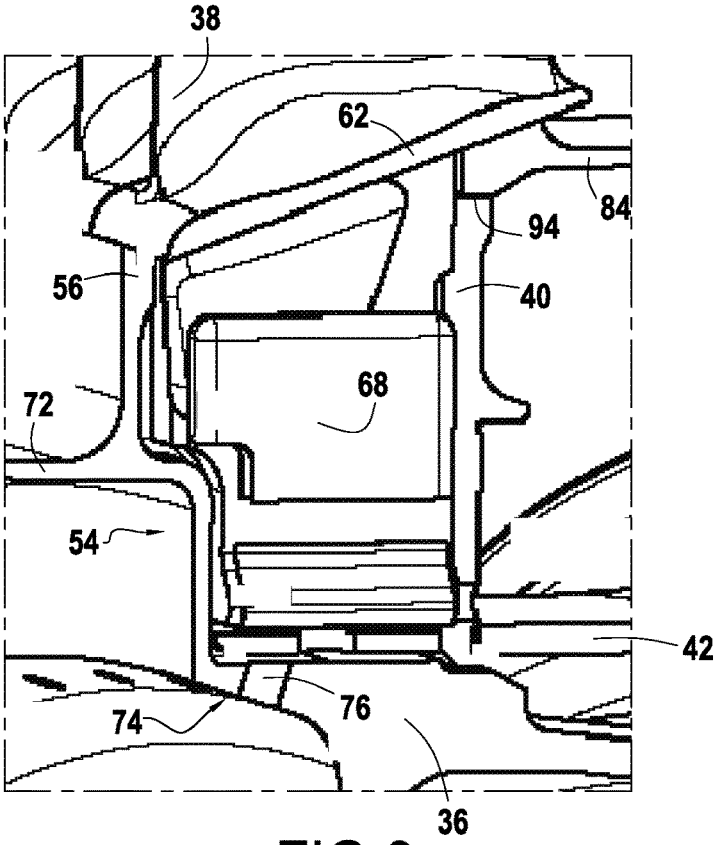
FIG. 8 is a partial and perspective view in partial section of a portion of FIG. 1 showing an assembly according to a second embodiment.
Figure 9:
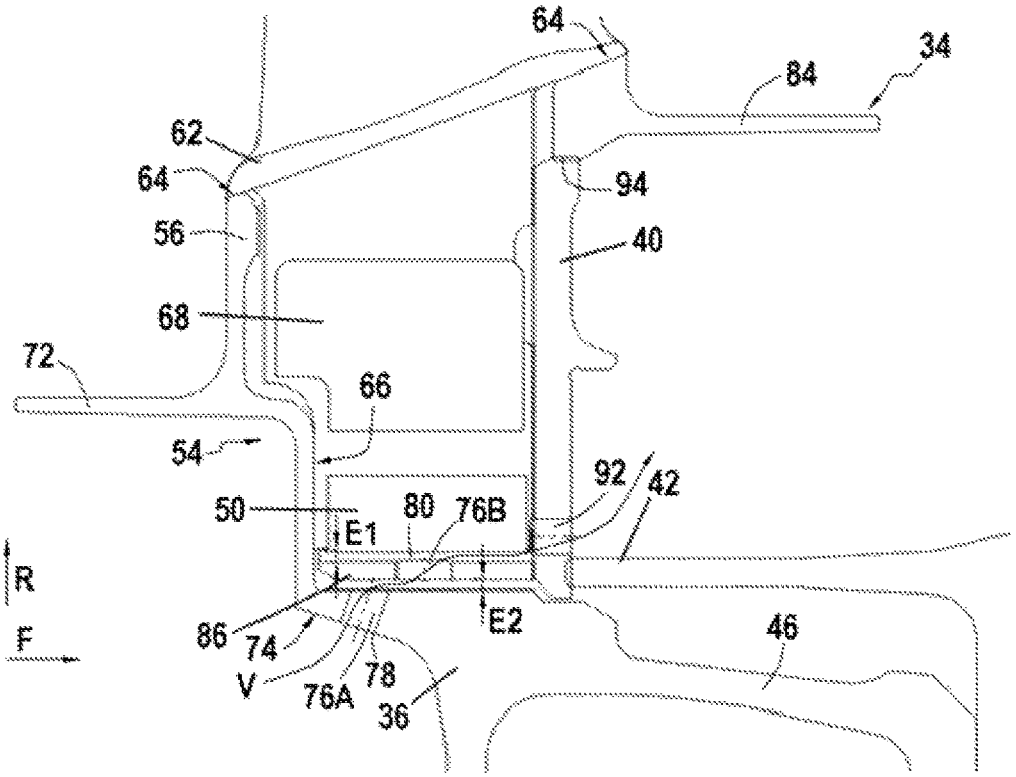
FIG. 9 is a side view of the assembly of FIG. 8.

As can be seen in particular in FIGS. 5 to 7, the disc 36 of the rotor includes at its periphery a plurality of cells 44.

The disc 36 of the rotor includes at least one connecting shroud 46 allowing in particular to assemble the movable ring 42 and the disc 36, for example by means of a plurality of bolts disposed in a circumferential direction C in axial orifices carried by the downstream connecting shroud 46 of the disc 36 and by the movable ring 42.

As shown in FIGS. 2 and 3, the blade 38 is assembled on the first disc 36 by inserting a blade root 48 into the blade root receiving cell 44. In cross-sectional view in a radial plane, the blade root 48 has a general bulb shape with a wider portion towards the inner end of the blade 38 and a portion whose width decreases towards the shank of the blade 60.

As can be seen in FIG. 5, the cell 44 is delimited in the circumferential direction C by teeth 52 forming portions of the disc 36. Each cell 44 includes an upstream radial wall 54. The upstream radial wall 54 is integral with the teeth 52 of the disc 36 and therefore is integral with the disc 36 and allows axially blocking the blade root 48 in the cell 44.

In the embodiment of FIGS. 2 and 3, the blade root 48 is coated with a foil 50. The foil 50 allows in particular protecting the blade root 48 and the teeth 52 against wear.

In the embodiment of FIGS. 2 to 7, the upstream radial wall 54 is prolonged outward in the radial direction R to form an extended upstream radial wall 56. It is therefore understood that the upstream radial wall 54 includes the extended upstream radial wall 56.

In the embodiment of FIGS. 2 to 7, each cell 44 opens into a cavity 58 for receiving a blade shank 60.

Thus, the extended upstream radial wall 56 extends in the radial direction R up to a distance allowing an inner platform 62 of the blade to abut against the extended upstream radial wall 56 of the disc 36. Thus, the disc 36 and particularly the extended upstream radial wall 56 includes a radial bearing surface 64 configured to form a radial end stop of the inner platform 62 of the blade 38.

In the embodiment of FIGS. 2 to 7, the disc 36 and particularly the extended upstream radial wall 56 of the upstream radial wall 54 includes an axial stop surface 66 forming an axial end stop of the blade 38 when the blade 38, particularly the blade shank 60, is inserted into the cavity 58.

In the embodiment of FIGS. 2 to 7, each cavity 58 receives a blade shank 60 and two damping elements 68. The damping elements 68 are disposed circumferentially on both sides of the blade shank 60.

In the embodiment of FIGS. 2 to 7, the cavity 58 is delimited by inter-cavity walls 70 disposed circumferentially and which extend radially outwards in the continuation of each tooth 52.

In the embodiment of FIGS. 2 to 7, the radial bearing surface 64 allows a bearing of the inner platform 62 of the blade 38 on three sides of the blade 38, an upstream bearing on the extended upstream radial wall 56 and two lateral bearings in the circumferential direction C on the inter-cavity walls 70. The radial bearing surface 64 also allows ensuring that there is a space E between the walls of the cell 44 and the blade root 48 so that the cooling air flow V may circulate in the cell 44. It is understood that the radial bearing surface 64 is carried by the extended upstream wall 56 and the inter-cavity walls 70.

In the embodiment of FIGS. 2 to 7, the extended upstream radial wall 56 includes an upstream spoiler 72 integral with the disc 36, particularly with the extended upstream radial wall 56. It is understood that the upstream radial wall 54, including the extended upstream radial wall 56, the upstream spoiler 72 and the disc 36 are made in one piece, that is to say that these elements are not assembled with each other after manufacturing the various elements.

In the embodiment of FIGS. 2 to 7, the upstream radial wall 54 has a stepped shape, a first section of the upstream radial wall 54 and a second section of the upstream radial wall 54 being connected by an intermediate section extending in the continuation of the upstream spoiler 72. It is understood that the first and the second section are not in a same radial plane. However, this embodiment is a non-limiting example.

In the embodiment of FIGS. 2 to 7, each cell 44 is connected to an upstream surface 74 of the disc 36 by a ventilation channel 76 of the cell 44. Each ventilation channel 76 includes an inlet orifice 78 which opens onto the upstream surface 74 of the disc 36 and an outlet orifice 80 which opens into the cell 44.

As shown in FIG. 3, in an axial cross-sectional plane, that is to say including the main axis A, the ventilation channel 76 has an inclination relative to the radial direction R. Thus, the axis of the ventilation channel 76 has an angle $\alpha$ with the radial direction R. It is understood that in a radial plane, that is to say a plane perpendicular to the main axis A, the inlet orifice 78 and the outlet orifice 80 are not aligned. Considering that the ventilation channel 76 has the general shape of a circular cylinder, it is understood that the center of the inlet orifice 78 and the outlet orifice 80 are not included in the same radial plane. Thus, when the ventilation channel 76 has the general shape of a circular cylinder and according to the orientation of the axis of the ventilation channel 76 and of the planes including the inlet orifice 78 and the outlet orifice 80, it is understood that these orifices may have a shape between the circle (surface perpendicular to the axis of the ventilation channel 76) and the ellipse (surface not perpendicular to the axis of the ventilation channel 76).

In the embodiment of FIGS. 2 to 7, each cell 44 is cooled by a cooling air flow V coming from upstream of the disc 36. The cooling air flow V enters the ventilation channel 76 through the inlet orifice 78 disposed on the upstream surface 74 of the disc 36, traverses the ventilation channel 76 and penetrates in the cell 44 through the outlet orifice 80 of the ventilation channel 76. The cooling air flow V passes through the cell 44 and exits downstream from the disc 36. The cooling air flow V is then channeled between the disc 36 and the movable ring 42, particularly between the connecting shroud 46 of the disc 36 and the movable ring 42 and then passes through a ventilation orifice 82 of the movable ring 42.

It will be noted that in the embodiment of FIGS. 2 to 7, the inner platform 62 of the blade 38 includes a downstream spoiler 84 and that the blade 38 is devoid of a downstream holding hook. In a sectional view in a radial plane, the blade root 48 has a general bulb shape with a wider portion towards the inner end of the blade 38 and a portion whose width decreases towards the blade shank 60.

For example, the disc 36 may be produced by additive manufacturing, particularly by an additive manufacturing method on a powder bed. The disc 36 may also be produced by conventional machining, for example by milling.

Assembling the assembly 34 according to the first embodiment will be described with reference to FIGS. 3, 4, 6 and 7.

Figure 4:
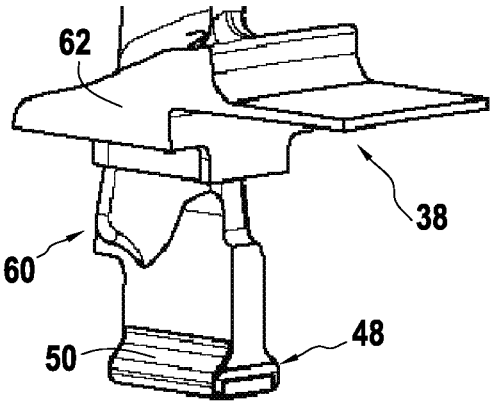
FIG. 4 is a partial perspective view of a blade of FIG. 3.

As shown in FIG. 4, each blade root 48 is coated with a foil 50.

As shown in FIG. 6, the blades 38 are assembled on the disc 36 by axial insertion of the blade root 48 in the cell 44 and the blade shank 60 in the cavity 58 until the blade 38 comes into contact with the axial stop surface 66 of the disc 36. When the blade 38 is inserted into the disc 36, the blade 38, particularly the inner platform 62 of the blade 38, rests on the radial bearing surface 64 of the disc 36.

As shown in FIGS. 6 and 7, the damping elements 68 are then inserted into the cavity 58 on both sides of the blade shank 60.

Assembling the blades 38 on the disc 36 may be done by inserting all the blades 38 on the disc 36 and by inserting the damping elements 68, once all the blades 38 inserted or the damping elements 68 may be inserted into a cavity 58 before proceeding to the insertion of the next blade. It may also be considered that an operator inserts the blades 38 and that another operator inserts the damping elements 68, both operations taking place on the same workstation, so that the blades 38 are inserted one after the other by one operator and the damping elements 68 are inserted one after the other by another operator, both operators not working on the same cavity 58.

The movable ring 42 including the downstream retaining ring 40 is then attached on a downstream face of the disc 36 in order to axially block the blades 38 in the disc 36, particularly in the cell 44 and the cavity 58. The disc 36 of the rotor is assembled to the movable ring 42, for example by means of a plurality of bolts disposed in a circumferential direction C in axial orifices carried by the downstream connecting shroud 46 the disc 36 and by the movable ring 42.

Thus, the assembly 34 of FIG. 3 is obtained.

In what follows, the elements common to the various embodiments are identified by the same reference numerals.

FIGS. 8 to 17 show a second embodiment of the assembly 34.

Figure 12:
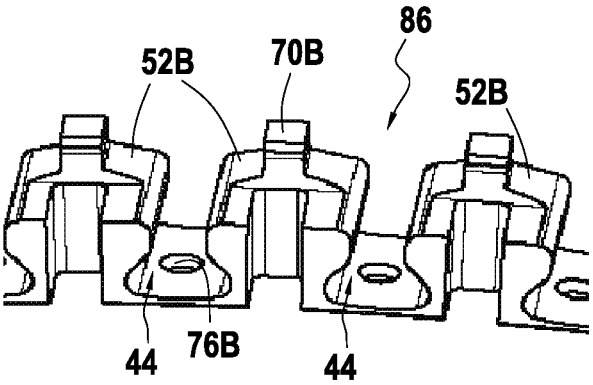
FIG. 12 is a partial perspective view of a crown carrying teeth.

In the embodiment of FIGS. 8 to 17, some elements are included partly in the disc 36 and partly in the crown 86. The elements included in the disc are identified by the letter "A" and the elements included in the crown are identified by the letter "B". As shown in FIG. 12, the crown 86 includes a plurality of teeth 52B of the crown 86, two adjacent teeth 52B partially delimiting the cell 44, the crown 86 includes a plurality of ventilation channels 76B of the crown 86, each ventilation channel 76B of the crown 86 including an outlet orifice 80 which opens into a cell 44 and a plurality of inter-cavity walls 70B of the crown 86. Similarly, the disc 36 includes a plurality of ventilation channels 76A of the disc 36, each ventilation channel 76A of the disc 36 including an inlet orifice 78 which opens onto the upstream surface 74 of the disc 36, a plurality of inter-cavity walls 70A of the disc 36, each inter-cavity wall 70A of the disc 36 being prolonged radially inwards by a disc 36 tooth wall 52A, as in particular shown in FIGS. 11A and 11B.

It is understood that the crown 86 and the disc 36 are two separate elements.

When the crown 86 is assembled with the disc 36, the teeth 52B of the crown 86 cooperate with the disc 36 tooth walls 52A to form the teeth 52. Similarly, the inter-cavity wall 70A of the disc 36 cooperates with the inter-cavity wall 70B of the crown 86 to form an inter-cavity wall 70. Similarly, the ventilation channel 76 is formed by the ventilation channel 70A of the disc 36, a space E2 present between the disc 36 and the crown 86 and the ventilation channel 70B of the crown 86.

In the embodiment of FIGS. 8 to 17, the disc 36 includes the downstream spoiler 84. Thus, the blade 38 is devoid of an upstream spoiler 72 and downstream spoiler 84.

In the embodiment of FIGS. 8 to 17, the radial bearing surface 64 allows a bearing of the inner platform 62 of the blade 38 on four sides of the blade 38, an upstream bearing, a downstream bearing and two lateral bearings in the circumferential direction C. The radial bearing surface 64 also allows ensuring that there is a space E1 between the walls of the cell 44 and the blade root 48 so that the cooling air flow V may circulate in the cell 44.

It will also be noted that in the embodiment of FIGS. 8 to 17, the axial stop surface 66 is carried by the portion of the upstream radial wall 54 which is not the extended upstream radial wall 56.

In the embodiment of FIGS. 8 to 17, the downstream retaining ring 40 and the movable ring 42 are two separate elements. The downstream retaining ring 40 includes a plurality of ventilation orifices 92 and the movable ring 42 is devoid of a ventilation orifice.

Assembling the assembly 34 according to the second embodiment will be described with reference to FIGS. 8 to 17.

Figure 10:
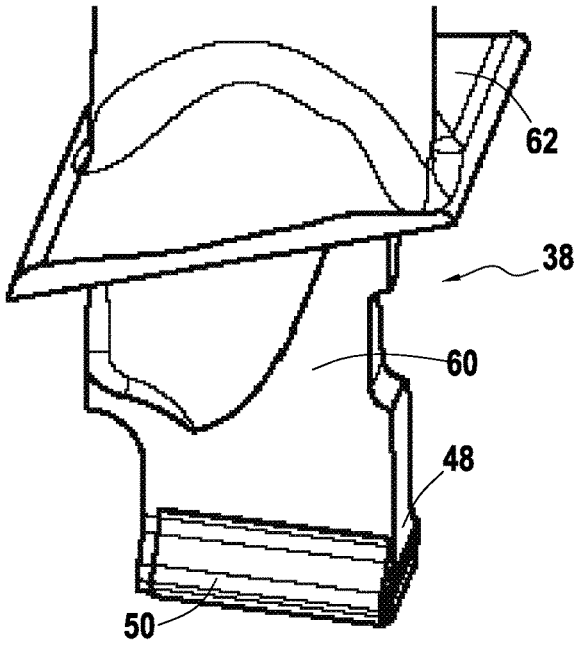
FIG. 10 is a partial perspective view of a blade of FIG. 9.
Figure 11A:
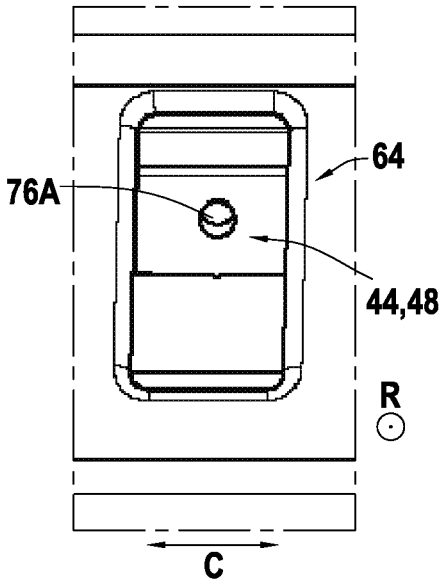
FIGS. 11A and 11B are partial perspective views of the turbine disc of FIG. 9.
Figure 11B:
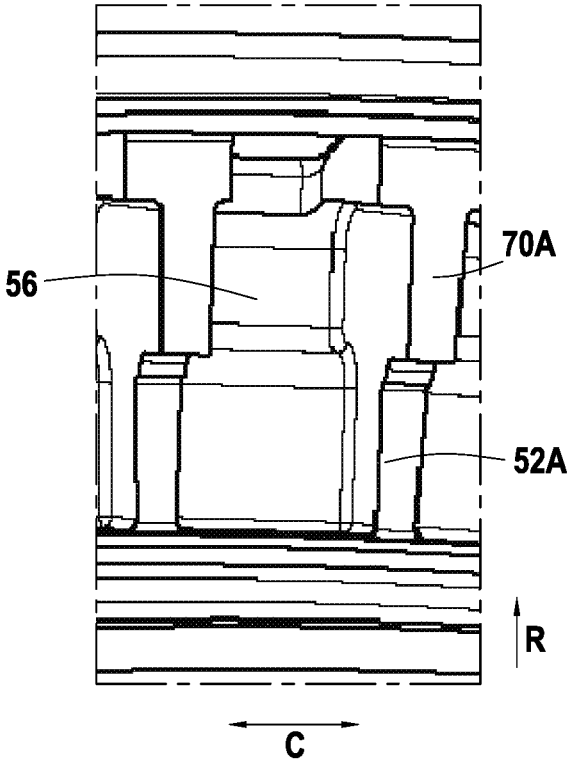

As shown in FIG. 10, each blade root 48 is coated with a foil 50.

Figure 13:
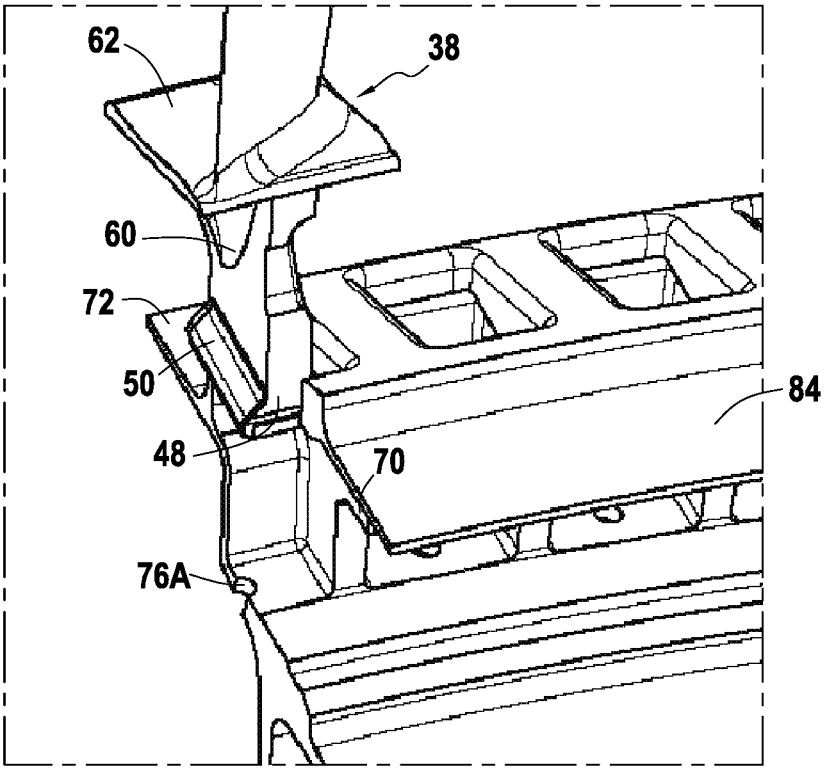
FIG. 13 is a partial perspective view of a step of assembling the assembly of FIG. 9.

As shown in FIG. 13, the blades 38 are assembled on the disc 36 by radial insertion of the blade root 48 into the cavity 58 until the blade 38 comes into contact with the axial stop surface 66 of the disc 36. When the blade 38 is inserted into the disc 36, the blade 38, particularly the inner platform 62 of the blade 38, rests on the radial bearing surface 64 of the disc 36.

Figure 14:
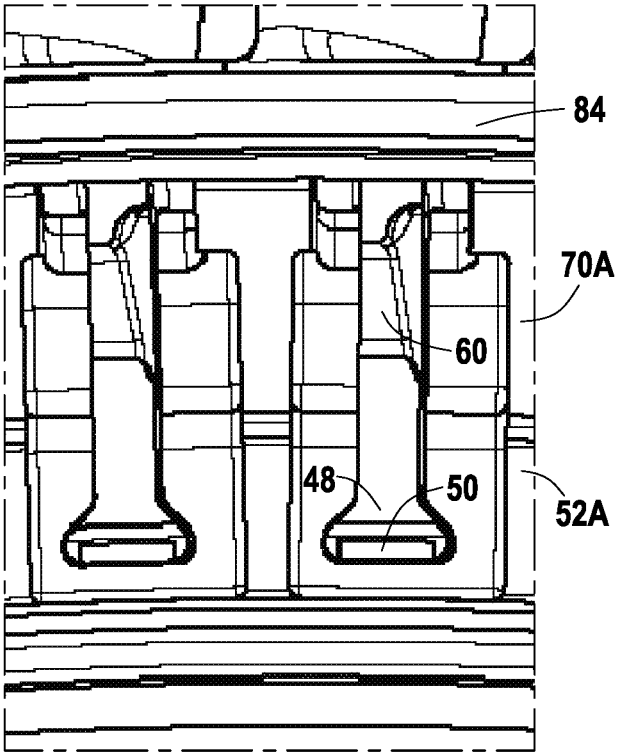
FIG. 14 is a partial perspective view of a step of assembling the assembly of FIG. 9.
Figure 15:
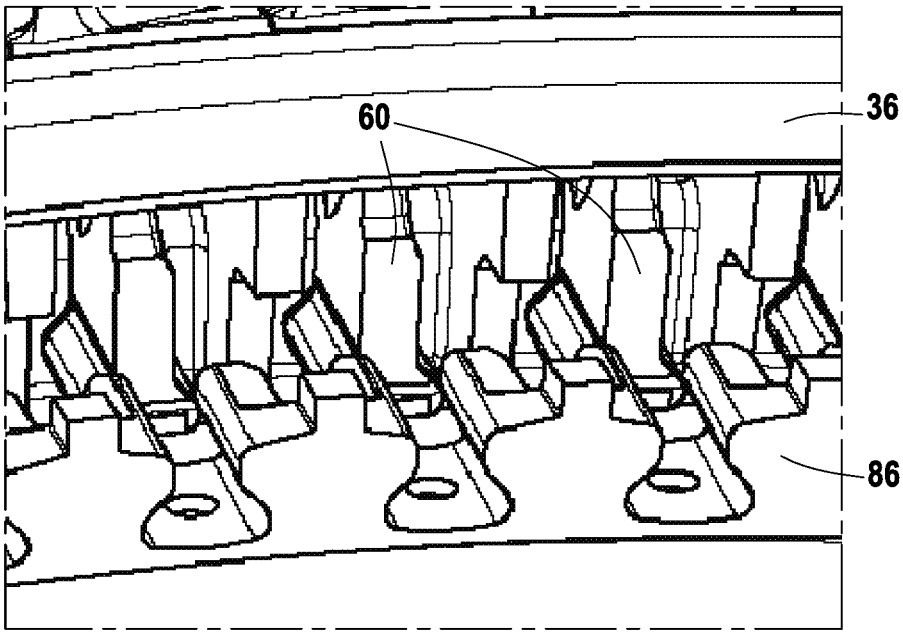
FIG. 15 is a partial perspective view of a step of assembling the assembly of FIG. 9.

As shown in FIGS. 14 and 15, once all the blades 38 inserted, the crown 86 is put in place.

Figure 16:
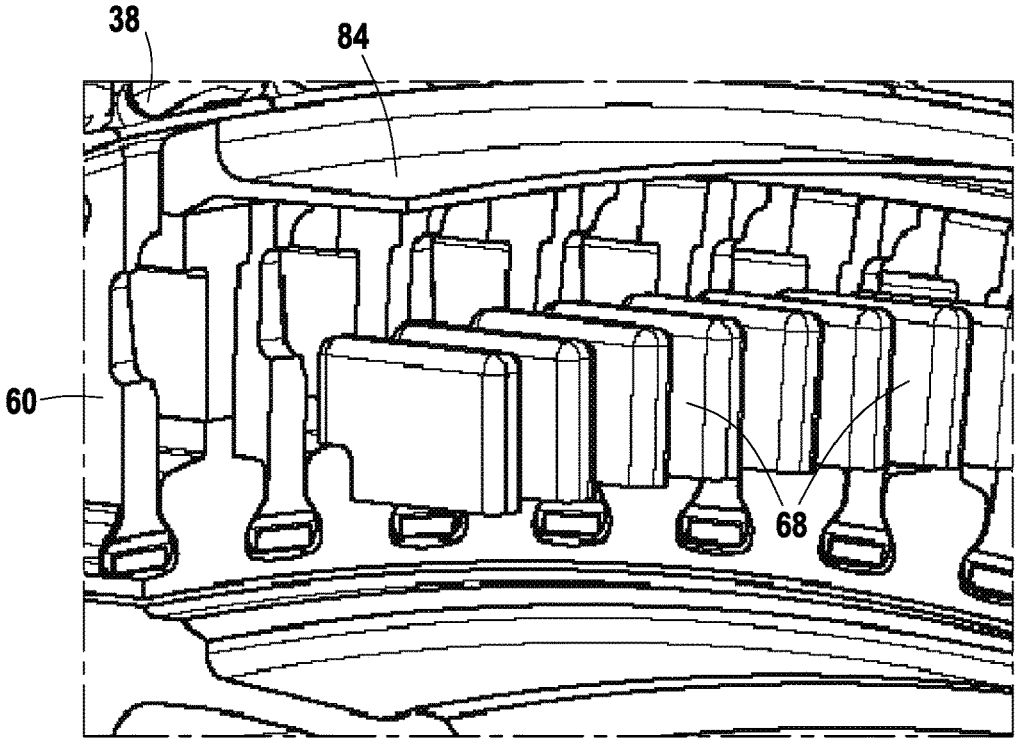
FIG. 16 is a partial perspective view of a step of assembling the assembly of FIG. 9.

As shown in FIG. 16, the damping elements 68 are then inserted into each cavity 58 on both sides of the blade shank 60.

Figure 17:
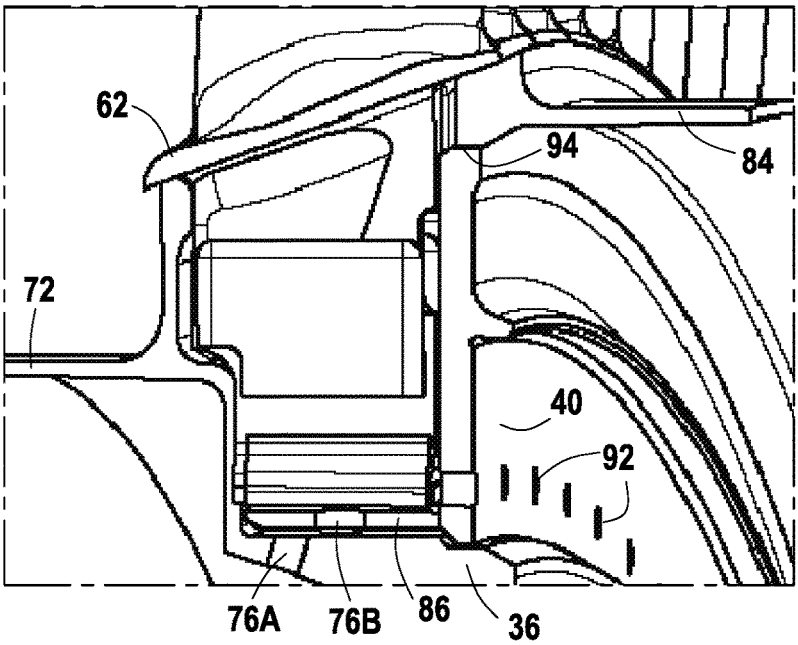
FIG. 17 is a partial perspective view of a step of assembling the assembly of FIG. 9.

As shown in FIG. 17, the downstream retaining ring 40 is then attached on a downstream face of the disc 36 in order to axially block the blades 38 in the disc 36, particularly in the cell 44 and the cavity 58. The downstream retaining ring 40 may for example be shrink-fitted onto the external periphery 94 thereof. The downstream retaining ring 40 may also be shrink-fitted onto the external and internal periphery thereof.

As shown in FIG. 17, the movable ring is attached on the downstream retaining ring 40 and the disc 36 of the rotor is assembled to the movable ring 42, for example by means of a plurality of bolts disposed in a circumferential direction C in orifices carried by the downstream connecting shroud 46 of the disc 36 and by the movable ring 42.

Thus, the assembly 34 of FIG. 17 is obtained.

The third embodiment is similar to the first embodiment. It differs therefrom in that the radial bearing surface 64 is prolonged to the cavity 58 by a sealing bearing surface 100 of a seal 98 carried by a blade 38.

Figure 18:
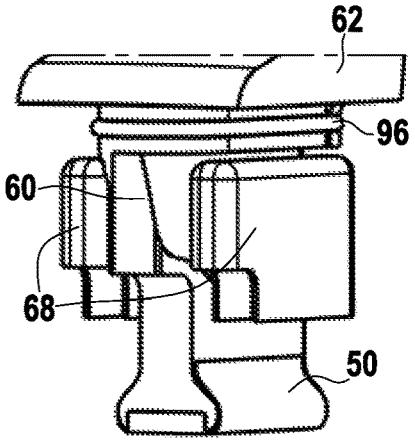
FIG. 18 is a partial perspective view of a blade according to a third embodiment.
Figure 19:
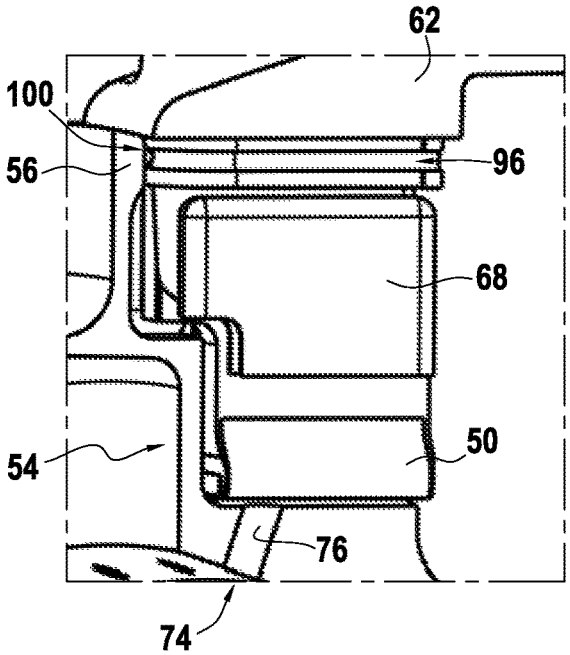
FIG. 19 is a partial and perspective view in partial section of a portion of FIG. 1 showing an assembly according to the third embodiment.
Figure 20:
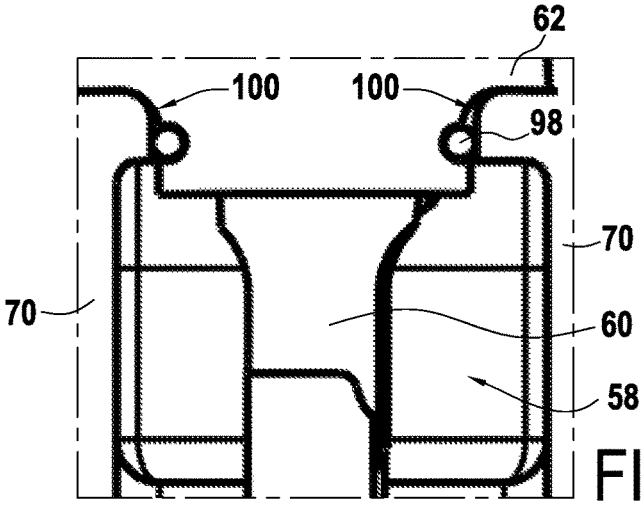
FIG. 20 is a partial view of the assembly of the third embodiment.

In the embodiment of FIGS. 18-20, the sealing bearing surface 100 is carried by the extended upstream wall 56 and the inter-cavity walls 70.

Particularly, in the embodiment of FIGS. 18-20, by a projection in the circumferential direction C of the external radial end of the inter-cavity walls 70.

In the embodiment of FIGS. 18-20, the seal 100 has a "U" shape and is received in a seal receiving groove 96, the groove 96 being carried by the blade 38. The seal 98 being received in the seal receiving groove 96, the position of the seal 98 is determined by the groove 96 and the seal 98 is blocked in the groove 96.

It is understood that the seal 98 may be integrated into the second embodiment.

Although the present disclosure has been described with reference to specific exemplary embodiments, it is obvious that various modifications and changes can be made to these examples without departing from the general scope of the invention as defined by the claims. For example, the inlet orifice may not be aligned in a direction parallel to the main axis A with the outlet orifice; the cell may not open into a blade shank receiving cavity, that is to say that the upstream radial wall may not be prolonged to the inner platform of the blade; an inlet orifice of the ventilation channel may be common to several ventilation channels, that is to say that an inlet orifice may be in fluid communication with several outlet orifices and therefore with several cells; the blade may include a downstream hook for holding a downstream ring for retaining a blade in the cell; the ventilation channel may not have the shape of a circular cylinder; the ventilation channel may not have the shape of a cylinder of revolution.

Furthermore, individual characteristics of the various mentioned embodiments may be combined in additional embodiments. Consequently, the description and the drawings are to be regarded in an illustrative rather than restrictive sense.

The invention claimed is:

1. A rotor disc for a turbomachine, the rotor disc extending circumferentially around an axis and comprising a plurality of cells configured to receive and radially retain blade roots and each cell comprising an upstream radial wall configured to axially block a corresponding blade root in the cell, each cell being connected to an upstream surface of the rotor disc by a ventilation channel of the cell, the ventilation channel comprising an inlet orifice which opens onto the upstream surface of the rotor disc and an outlet orifice which opens into the cell, each cell opening into a respective cavity for receiving a blade shank, wherein each respective cavity is delimited by inter-cavity walls disposed circumferentially and extending radially outward in continuation of teeth delimiting the cells.

2. The disc according to claim 1, wherein the upstream radial wall of each cell is prolonged outward in a radial direction to form an extended upstream radial wall.

3. The disc according to claim 1, wherein the rotor disc comprises a radial bearing surface configured to form a radial end stop of a blade platform.

4. The disc according to claim 3, wherein the radial bearing surface is prolonged to each respective cavity by a sealing bearing surface of a seal carried by a blade.

5. The disc according to claim 1, wherein the upstream radial wall comprises an upstream spoiler.

6. The disc according to claim 1, wherein the upstream radial wall comprises an axial stop surface configured to form an axial end stop of a blade.

7. The disc according to claim 1, wherein each respective cavity is configured to receive a blade shank and two damping elements disposed circumferentially on both sides the blade shank.

8. The disc according to claim 1, wherein the rotor disc comprises an attached crown at least partially defining the plurality of cells, the ventilation channel of each cell being partially defined in the rotor disc and in the crown.

9. An assembly of a rotor disc according to claim 1, of a plurality of blades, a blade root being received in each cell, and of a downstream retaining ring fastened on the rotor disc and configured to axially block the blade root in the cell.

10. The assembly according to claim 9, wherein the downstream retaining ring is made in one piece with a movable ring.

11. The assembly according to claim 9, wherein at least one blade of the plurality of blades comprises a seal receiving groove and a seal received in the groove, the rotor disc comprising a radial bearing surface configured to form a radial end stop of a blade platform, the radial bearing surface being prolonged to each of the respective cavities by a sealing bearing surface of the seal carried by the at least one blade, the seal cooperating with the sealing bearing surface of the rotor disc.

12. A turbomachine comprising an assembly according to claim 9.

* * * * *